US007860258B2

(12) United States Patent
Azuma et al.

(10) Patent No.: US 7,860,258 B2
(45) Date of Patent: Dec. 28, 2010

(54) ELECTRO-ACOUSTIC TRANSDUCER DEVICE

(75) Inventors: Takashi Azuma, Kawasaki (JP); Shin-ichiro Umemura, Muko (JP); Tatsuya Nagata, Ishioka (JP); Hiroshi Fukuda, Tokyo (JP); Shuntaro Machida, Kokubunji (JP); Toshiyuki Mine, Fussa (JP)

(73) Assignee: Hitachi, Ltd., Tokyo (JP)

( * ) Notice: Subject to any disclaimer, the term of this patent is extended or adjusted under 35 U.S.C. 154(b) by 1191 days.

(21) Appl. No.: 11/491,198

(22) Filed: Jul. 24, 2006

(65) Prior Publication Data

US 2007/0057603 A1 Mar. 15, 2007

(30) Foreign Application Priority Data

Sep. 5, 2005 (JP) ..... 2005-255817

(51) Int. Cl.
*H04R 25/00* (2006.01)

(52) U.S. Cl. ..... 381/175; 381/191

(58) Field of Classification Search ..... 381/174, 381/175, 190, 191; 367/140, 170, 181; 310/311, 310/324, 327, 334
See application file for complete search history.

(56) References Cited

U.S. PATENT DOCUMENTS

2003/0048914 A1* 3/2003 Yi et al. ..... 381/190
2005/0177045 A1* 8/2005 Degertekin et al. ..... 367/140

OTHER PUBLICATIONS

Haller, Matthew I et al, "A Surface Micromachined Electrostatic Ultrasonic Air Transducer", IEEE Ultra Sonic Symposium, 1994, pp. 1241-1244.

Hohm, D. et al, "Silicon-dioxide electret transducer", Accust. Soc. Am, Apr. 1964, pp. 1297-1298.

Amjadi, Houman et al, "Silicon-based Inorganic Electrets for Application in Micromachined Devices", IEEE Transactions on Dielectrics and Electrical Insulation, vol. 3, No. 4, Aug. 1996, pp. 494-498.

* cited by examiner

*Primary Examiner*—Brian Ensey
(74) *Attorney, Agent, or Firm*—Stites & Harbison, PLLC; Juan Carlos A. Marquez, Esq

(57) ABSTRACT

A transducer for transmitting and receiving ultrasonic waves to a diaphragm-based ultrasonic transducer device using silicon as a base material. An electro-acoustic transducer device which can have a first electrode formed on top of, or inside, a substrate and having a thin film provided on top of the substrate. The device can also have a second electrode formed on top of, or inside, the thin film. A void layer can be provided between the first electrode and the second electrode. A charge-storage layer can be provided between the first electrode and the second electrode. A source electrode and a drain electrode can also be provided for measuring a quantity of electricity stored in the charge-storage layer.

9 Claims, 8 Drawing Sheets

ELECTRO-ACOUSTIC TRANSDUCER DEVICE

CLAIM OF PRIORITY

The present application claims priority from Japanese application JP 2005-255817 filed on Sep. 5, 2005, the content of which is hereby incorporated by reference into this application.

FIELD OF THE INVENTION

The present invention relates to a transducer for transmitting and receiving ultrasonic waves and in particular, to a diaphragm-based ultrasonic transducer device using silicon as a base material.

BACKGROUND OF THE INVENTION

Progress made in such piezoelectric materials having large and stable piezoelectricity as represented by a PZT (lead zirconate titanate) based piezoelectric ceramic, a piezoelectric transducer using the same, and a semiconductor transmit-receive circuit highly adaptable to the piezoelectric transducer has contributed to remarkable development and widespread use of an ultrasonic technology during the latter half of the $20^{th}$ century. In the early years of the $20^{th}$ century, the human race started an attempt to transmit and receive ultrasonic waves by utilizing a piezoelectric effect that was discovered by the Curie brothers in the latter half of the $19^{th}$ century. However, even though a rock crystal of which they discovered the piezoelectric effect has piezoelectric properties so stable as to enable it to be used in a clock even today, the rock crystal is low in electro-mechanical conversion efficiency, and in particular, sensitivity of a signal-receiving transducer using the same is low, which has turned out to be its main drawback. There has since been found a Rochelle salt that is very high in electro-mechanical conversion efficiency. The Rochelle salt, however, has since been found prone to undergo deliquescence, posing a problem with crystal stability, so that particular caution has been required in order to enable it to obtain a stable piezoelectric property. Nevertheless, because a substitute for the Rochelle salt was unavailable during World War II, an ultrasonic transducer was completed by use of the Rochelle salt, and subsequently, a sonar was developed by use of the ultrasonic transducer. Immediately after World War II, barium titanate whose electro-mechanical conversion efficiency is high and stable was found having piezoelectricity. Since barium titanate is a ceramic, it has an advantage of high flexibility in product shape, and a concept called "piezoelectric ceramics" was thereby born. Subsequently, lead zirconate titanate (PZT) ceramic higher in Curie point than barium titanate, thereby having more stable piezoelectric properties, was discovered late in the $20^{th}$ century, and has since come into widespread use for the ultrasonic transducer in commercial application up to now.

Meanwhile, there is the need for an electronic circuit accompanying the ultrasonic transducer, for driving the ultrasonic transducer at the time of signal transmission, and amplifying electric signals received by the ultrasonic transducer at the time of signal reception, and a circuit made up of vacuum tubes was in use during a time period from the days of the sonar developed during World War II, and up to 1970s. In comparison with an electronic circuit for audio-frequency range, in which semiconductor was adopted early on after a transistor was invented immediately after World War II, an electronic circuit for ultrasonic waves had a higher operational frequency range, so that adoption of semiconductor for the electronic circuit for the ultrasonic waves was delayed by about 20 years. With a drive circuit for signal transmission, in particular, an operation at a high voltage is required, so that adoption of semiconductor for the drive circuit had to wait until commercial application of a high-speed thyristor, and further, widespread use of the high-speed thyristor had to wait until commercial application of a high-voltage-resistant field effect transistor (FET).

As described above, a piezoelectric ceramic-based ultrasonic transducer presently represents the majority of ultrasonic transducers that are in commercial application. With the aim of replacing the piezoelectric ceramic-based ultrasonic transducer, R and D on the construction of a microscopic diaphragm-based transducer by use of a technology for micro-machining semiconductor, as represented by one described in Proceedings of 1994 IEEE Ultrasonics Symposium, pp. 1241-1244, were started from 1990s onwards.

According to a typical basic structure thereof, a capacitor is formed by electrodes 2, 3 that are provided on a substrate 1, and a diaphragm 5, respectively, with a void 4 interposed therebetween. When a voltage is applied across those electrodes, electric charges with polarities opposite to each other are induced on the respective electrodes, thereby exerting an attracting force on each other, so that the diaphragm undergoes displacement. If the outer side of the diaphragm is in contact with water and a living body at this point in time, acoustic waves are emitted into those media, which is the principle underlying electro-mechanical conversion in signal transmission. On the other hand, if a given electric charge is kept induced on the respective electrodes by applying a DC bias voltage thereto, and vibration is forcefully given from a medium in contact with the diaphragm, thereby causing the diaphragm to undergo displacement, a voltage corresponding to the displacement is additionally generated. The principle underlying the electro-mechanical conversion in signal reception, described in the latter case, is the same as that for a DC bias capacitor microphone for use as a microphone in an audible sound range. The diaphragm-based transducer is made up of a mechanically hard material such as silicon, but features excellent acoustic impedance matching with a mechanically soft material such as the living body, water, and so forth because the diaphragm-based ultrasonic transducer has a diaphragm structure with the void provided on the back surface of the diaphragm. In the case of a conventional piezoelectric transducer using PZT, acoustic impedance is constant as an intrinsic physical property value of material, and in contrast thereto, apparent acoustic impedance of the diaphragm structure reflects not only material thereof but also a structure thereof. Accordingly, there is obtained flexibility in designing so as to match a target. Further, combination of the transducer with the transmit/receive circuit as described in the foregoing is a point of importance for the transducer, and construction of the transducer by use of silicon for the substrate thereof will lead to a feature in that a signal reception circuit and a signal transmission circuit can be provided in close proximity to the transducer so as to be integral therewith, respectively. Progress in development of the transducer has since been made, having lately reached a level comparable in respect of sensitivity of signal transmission/reception to that of the conventional piezoelectric transducer using PZT.

In J. Acoust. Soc. Am. vol. 75, 1984, pp. 1297-1298, there is disclosed an electret transducer using a semiconductor diaphragm structure. With the electret transducer, an insulating layer 5 with electric charges stored therein is provided at least either between an electrode 3 on a side of the transducer, adjacent to the diaphragm in FIG. 1, and the void 4, or between an electrode 2 on a side of the transducer, adjacent to the substrate, and the void 4. For a constituent material making up the insulating layer with the electric charges stored therein, use is made of a silicon compound film such as a silicon oxide film, silicon nitride film, and so forth, or a stack thereof, as shown in J. Acoust. Soc. Am. vol. 75, 1984, pp. 1297-1298, and IEEE Transactions on Dielectrics and Electrical Insulation vol. 3, No. 4, 1996, pp. 494-498. The insulating layer composed of those silicon compounds is formed by means of vapor growth by use of a process represented by CVD (Chemical Vapor Deposition), and it is possible to trap the electric charges not only on the surface of the compound layer but also in the compound layer by controlling magnitude of crystalline defects. For this purpose, by causing the insulating layer to undergo electrification under a high electric field beforehand, the electret transducer is used as an electro-acoustic transducer device having no necessity for the DC bias voltage.

SUMMARY OF THE INVENTION

Notwithstanding the above, in reality, the insulating layer is in unstable electrification state, and a quantity of electrification undergoes a drift while the insulating layer is in use. This creates a problem that electro-acoustic conversion efficiency, that is, the most fundamental property of the electro-acoustic transducer device undergoes a drift when the DC bias voltage is kept constant.

Even if the electro-acoustic conversion efficiency is at a satisfactory level in magnitude, difficulty in stabilizing the electro-acoustic conversion efficiency will present a major stumbling block to commercial application thereof as the transducer, as is evident from the case of the Rochelle salt, previously described by way of example. Effects of the drift in the conversion efficiency are serious particularly in the case where an array type transducer is made up of the electro-acoustic transducer devices described as above, including time-dependent change in properties of the device. Such effects include not only occurrence of drift in sensitivity of the electro-acoustic transducer in whole but also varying drift in electro-acoustic properties of the devices making up the array type transducer, in which case, there arises the risk of an acoustic noise increasing to a considerably high level when the electro-acoustic transducer in whole is actuated to form transmitting and receiving beams.

Accordingly, in order to make up the array type transducer, in particular, by use of the diaphragm-based electro-acoustic transducer devices of a charge storage type, and to enhance the properties of the array type transducer to a level of commercial application, it may be an important problem second only to high electro-acoustic conversion efficiency to overcome a drift problem.

In order to resolve those problems, the invention provides an electro-acoustic transducer device comprising a substrate using silicon or a silicon compound as a base material thereof, a first electrode formed on top of, or inside the substrate, a thin film using silicon or a silicon compound as a base material thereof, provided on top of the substrate, a second electrode formed on top of, or inside the thin film, a void layer provided between the first electrode and the second electrode, a charge-stored layer for storing charge given by the first electrode and the second electrode, provided between the first electrode and the second electrode, and a source electrode and a drain electrode, for measuring a quantity of electricity stored in the charge-storage layer. The quantity of the electricity in the charge-storage layer can be estimated by monitoring electrical resistance between the source electrode and the drain electrode.

According to the present invention, it is possible to monitor the quantity of the electricity in the charge-storage layer, and to suppress drift in device characteristics, which is the main cause for variation in device sensitivity, more than before. Further, it is possible to check deterioration in an ultrasonic beam at the time of signal transmission/reception, thereby preventing deterioration in azimuth resolution of an image, and dynamic range.

DETAILED DESCRIPTION OF THE PREFERRED EMBODIMENTS

Embodiments of the invention are described hereinafter with reference to the accompanying drawings.

Figure 1:
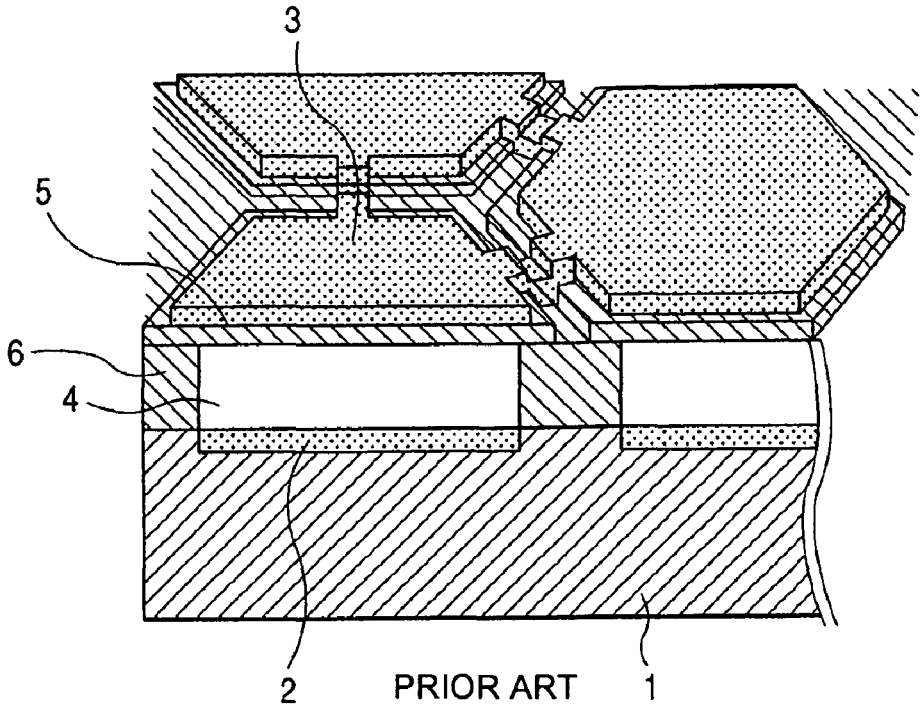
FIG. 1 is a conceptual view showing a structure of a semiconductor diaphragm type electro-acoustic transducer device.
Figure 2:
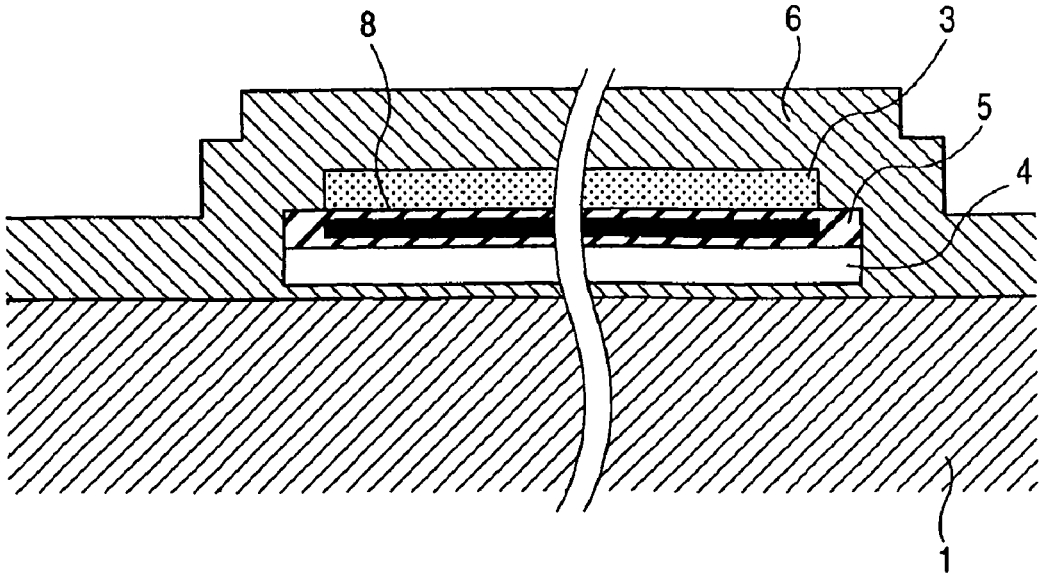
PRIOR ART FIG. 2
FIG. 2 is a sectional view showing an embodiment of an electro-acoustic transducer device according to the invention, using silicon as a base material.
Figure 6:
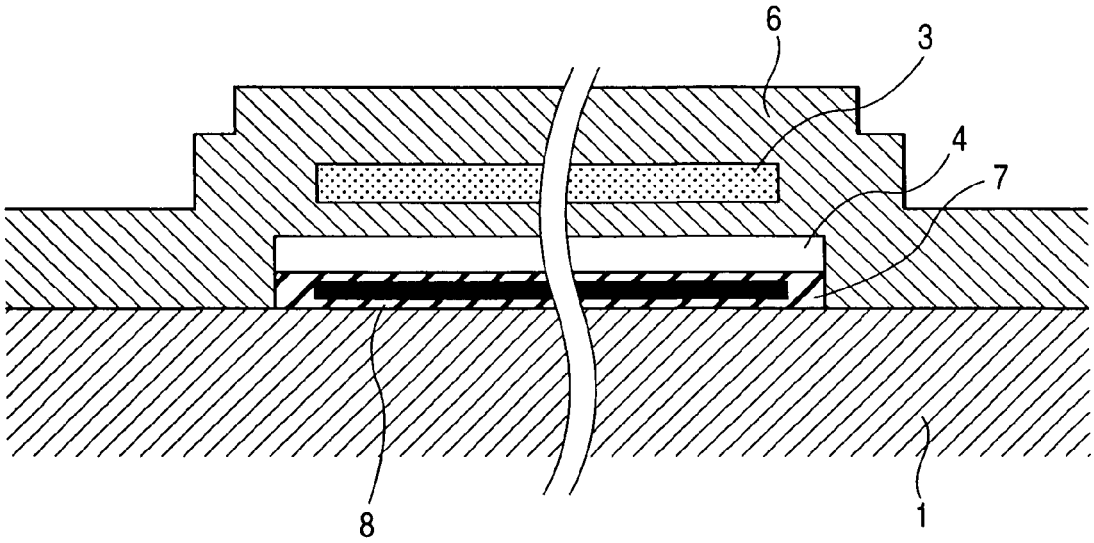
FIG. 6 is a sectional view showing the electro-acoustic transducer device according to the embodiment of the invention, using silicon as the base material.

FIG. 2 is a sectional view showing one embodiment of an electro-acoustic transducer device according to the invention, using silicon as a base material. The electro-acoustic transducer device comprises respective layers sequentially disposed in the following order from the bottom, including an n-type silicon (Si) substrate 1 doubling as a lower electrode 2, a first silicon compound layer, a void layer 4, a second silicon compound layer 5, an upper electrode 3 made of aluminum, and a first silicon compound layer 6. As for a thickness of each of the layers according to the present embodiment, the first silicon compound layer positioned under the void layer is 30 nm in thickness, the void layer is 100 nm in thickness, the second silicon compound layer is 200 nm in thickness, the upper electrode is 200 nm in thickness, and the first silicon compound layer positioned on top of the upper electrode is 1500 nm in thickness while a void positioned in a lower part of a diaphragm is 50 μm in inside diameter. The first silicon compound layer is made of common silicon nitride $Si_3N_4$, and the electro-acoustic transducer device is structured such that mechanical strength of the diaphragm is shouldered mainly by the first silicon compound layer positioned on top of the upper electrode. A charge-stored layer 8 with a thickness of 50 nm is embedded in the second silicon compound layer. Use is made of $SiO_2$, and so forth, for a second silicon compound surrounding the charge-storage layer 8, in order to check a leakage current occurring between the charge-storage layer 8, and the electrodes. There can be adopted a configuration in which the charge-storage layer 8 is embedded in a layer between the lower electrode 1 and the void 4, as a second silicon compound layer 7, as shown in FIG. 6. In such a case, there is no difference at all in effect for carrying out the invention regardless of whether the charge-storage layer 8 is positioned above or below the void except that the thickness of the first silicon compound layer, which is 50 nm according to an example show in FIG. 2, is changed to 200 nm in order to embed the charge-storage layer 8 therein, the constituent material of the first silicon compound layer is changed to a second silicon compound, and the thickness of the second silicon compound layer 5, which is 200 nm according to the example show in FIG. 2, is changed to on the order of 50 nm (as thin as practically possible) while the constituent material of the second silicon compound layer is changed to a first silicon compound.

Figure 3:
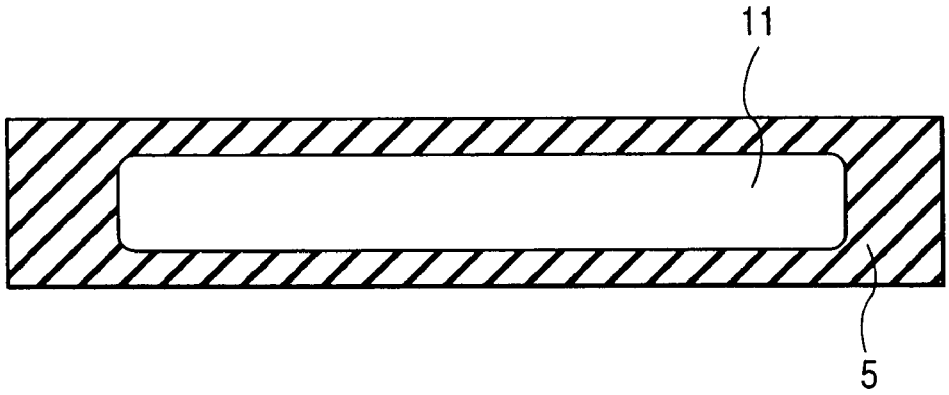
FIG. 3 is a sectional view showing an example of a charge-storage layer of the electro-acoustic transducer device using silicon as the base material, according to the embodiment of the invention.
Figure 4:
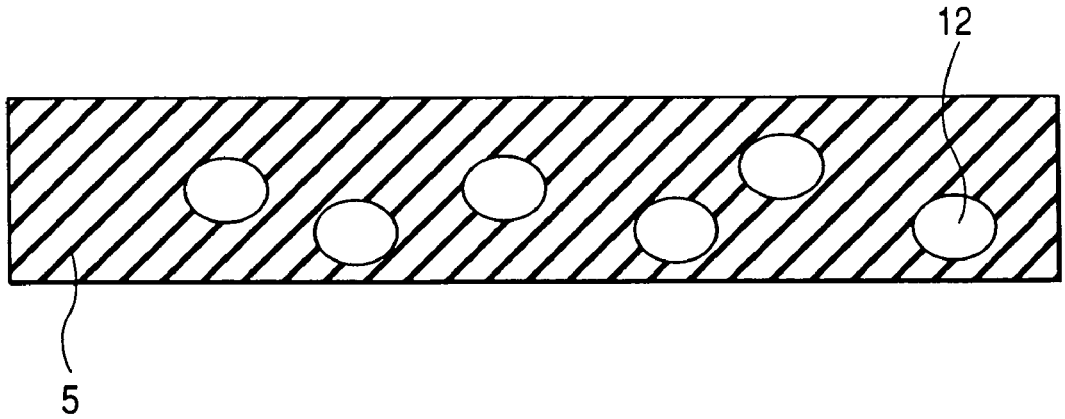
FIG. 4 is a sectional view showing another example of the charge-storage layer of the electro-acoustic transducer device using silicon as the base material, according to the embodiment of the invention.
Figure 5:
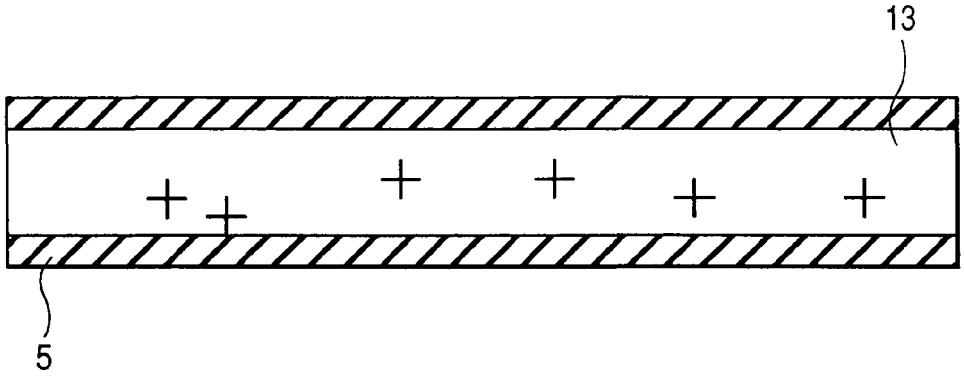
FIG. 5 is a sectional view showing still another example of the charge-storage layer of the electro-acoustic transducer device using silicon as the base material, according to the embodiment of the invention.

FIGS. 3 to 5 show respective examples of the specific structure of the charge-storage layer 8. First, with the example shown in FIG. 3, a conductive layer 11 composed of a metal or poly-Si, and so forth is formed inside the second silicon compound layer 5, which represents the same structure as that for a floating gate of the so-called flash memory, and so forth. Further, with another example shown in FIG. 4, conductor dots 12 composed of a metal or poly-Si, and so forth are formed inside the second silicon compound layer 5. With still another example shown in FIG. 5, a silicon nitride ($Si_3N_4$) layer 13 containing many defects is formed inside the second silicon compound layer 5. In the case of using the conductive layer 11 shown in FIG. 3, distribution of electric charges after injection can be easier anticipated, and variation in charge distribution by the device is smaller in magnitude. This case, however, has a drawback in that if the second silicon compound layer 5 is defective and once leakage occurs between the conductive layer 11 and the electrodes, all the electric charges stored in the conductive layer 11 will move out. On the other hand, in the case of using the conductor dots 12, or the silicon nitride ($Si_3N_4$) layer 13 containing many defects, the risk of all the electric charges being lost once the leakage occurs is deemed small, however, this case has a drawback in that it is difficult to inject electric charges so as to be evenly distributed. This is because there is a difference in electric field strength between a central part of the diaphragm and end parts thereof owing to a difference in thickness of the void therebetween at the time of injecting the electric charges, due to effects of Fowler-Nordheim tunneling current, and so forth, as described later, thereby causing a drawback that the electric charges are injected only at the central part of the diaphragm, in addition to a problem that since sites where the electric charges build up are located spatially at random, the sites will vary in location by the device.

Figure 14:
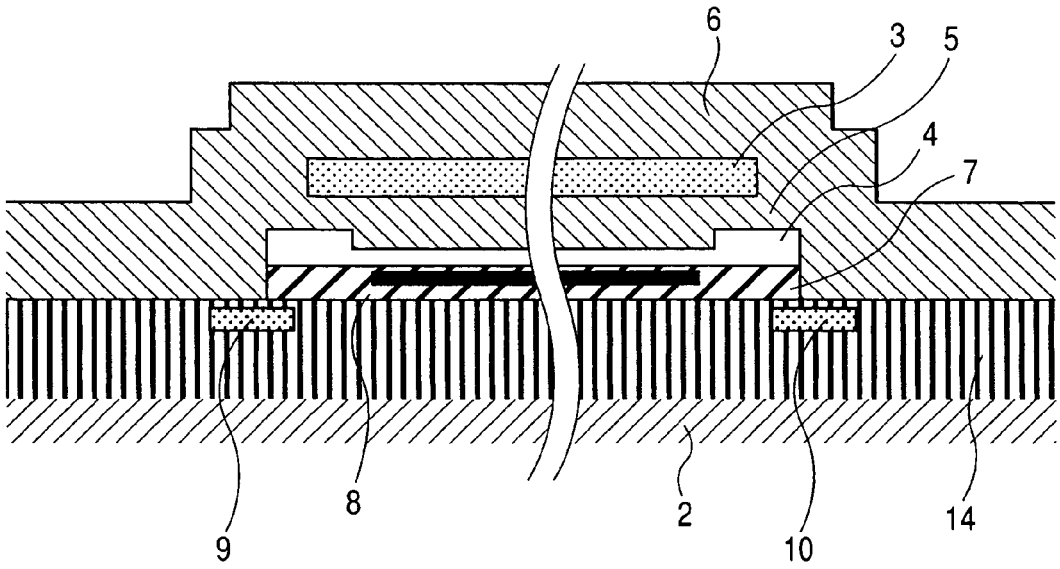
FIG. 14 is a sectional view showing another embodiment of an electro-acoustic transducer device according to the invention, using silicon as a base material.

If there exists variation in the initial shape of the diaphragm, due to variation in internal stress of the device and so forth, that is, variation in thickness of the void layer on a device-by-device basis, particularly when a device in reality is used, a grounding area, that is, an area into which the electric charges are injected will vary even if the same voltage is applied, resulting in occurrence of variation in sensitivity on a device-by-device basis. By forming the first silicon compound layer 6 such that the central part thereof is in a shape protruding downward as shown in FIG. 14, it is possible to check variation in the grounding area on a device-by-device basis. This is because fabrication is possible with less variation in thickness and diameter of the diaphragm as compared with the variation in the internal stress. If the radius of the charge-storage layer 8 is rendered smaller than the radius of the central part in the shape protruding downward, this will enable an area of a region where the electric charges are injected to be kept constant even in the case of the charge-storage layer 8 being structured as shown in FIGS. 4 and 5, respectively.

Figure 7:
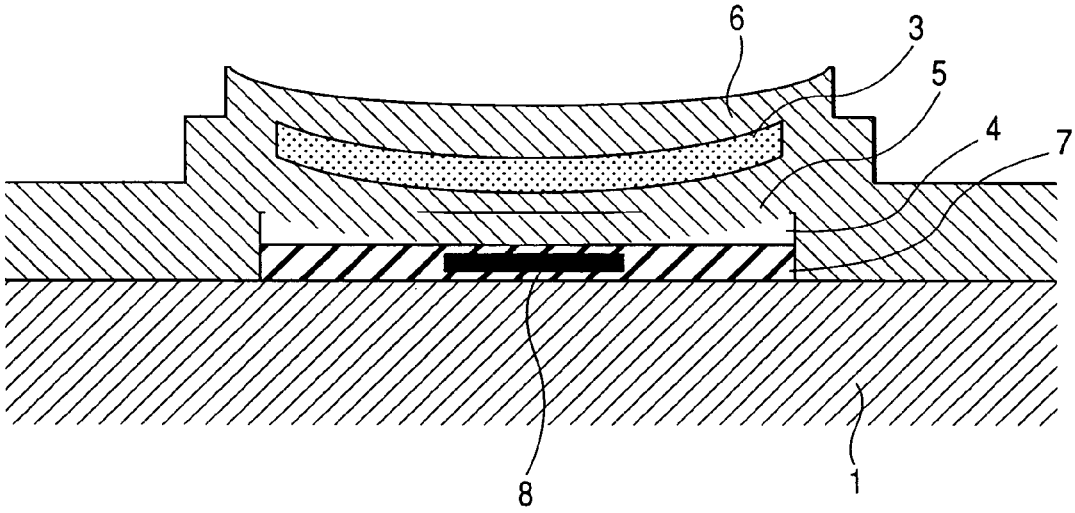
FIG. 7 is a sectional view showing the electro-acoustic transducer device according to the embodiment of the invention, using silicon as the base material, at the time of charge-injection.
Figure 8:
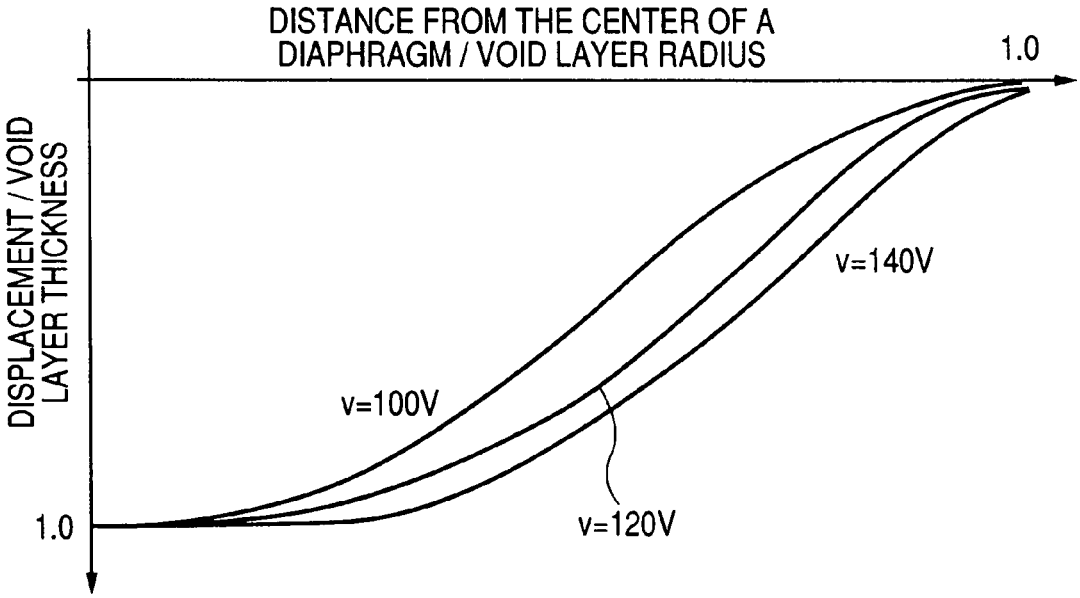
FIG. 8 is a diagram showing distance from the center of a diaphragm, and displacement of the diaphragm.
Figure 9:
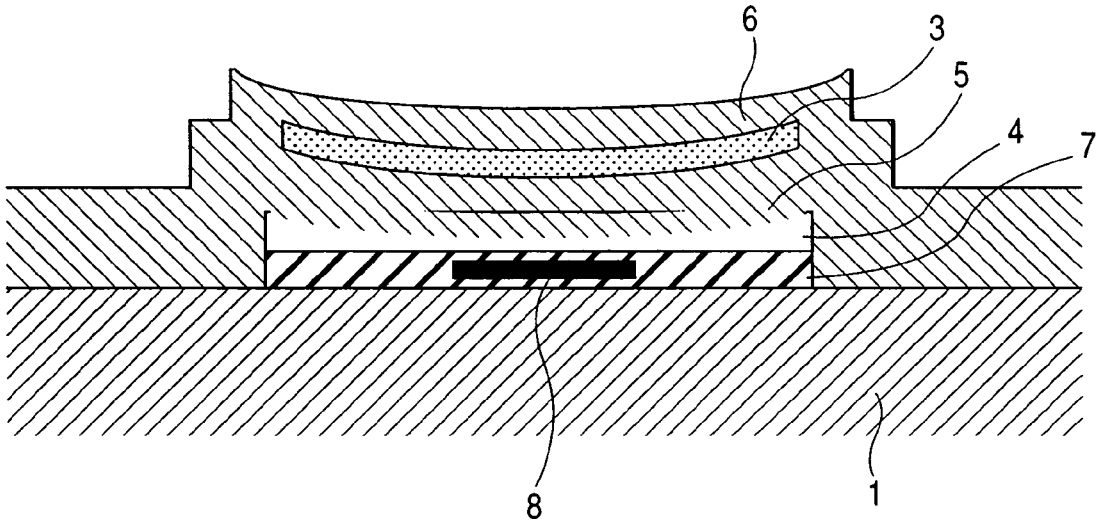
FIG. 9 is a sectional view showing the electro-acoustic transducer device according to the embodiment of the invention, using silicon as the base material, at the time of transmitting/receiving ultrasonic waves.
Figure 13:
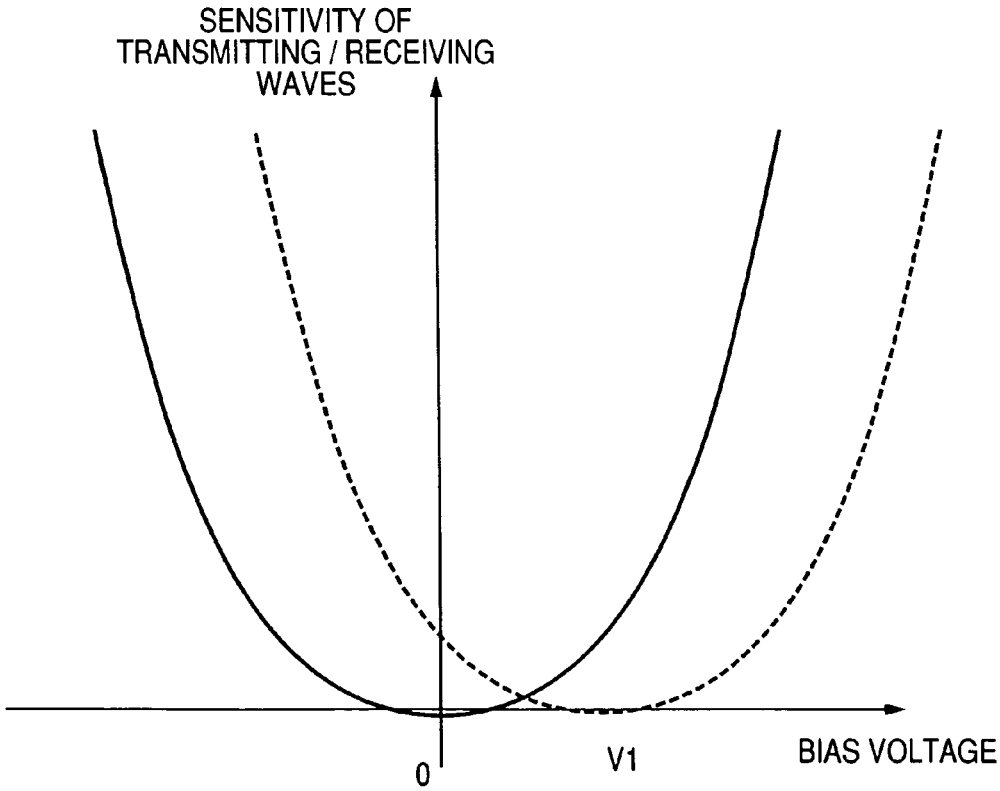
FIG. 13 is a graph illustrating change in dependency of transmitting/receiving wave sensitivity on bias voltage, due to charge storage.

Now, a charge-injection method is described hereinafter. When a DC bias (on the order of 100V) is applied across the upper and lower electrodes shown in FIG. 6, in a state prior to voltage application, the central part of the diaphragm undergoes the largest deformation as shown in FIG. 7, and upon the DC bias exceeding a value called a collapse voltage, the central part of the diaphragm is grounded to the surface of the second silicon compound layer 7. When a voltage is further applied to the diaphragm in that state, a length of a grounded portion of the diaphragm continues to increase following an increase in voltage, as shown in FIG. 8. In FIG. 8, the vertical axis indicates displacement/thickness of the void layer, and the horizontal axis indicates distance from the center of the diaphragm/a radius of the void layer. In a stricter sense, the thickness of the void layer means an initial thickness of the void layer, prior to the voltage application and charge-storage. Downward orientation of the displacement, in FIG. 7, is designated as positive. A distance between the upper and lower electrodes, which is about 350 nm prior to grounding, decreases down to 250 nm, so that electric field strength increases 1.4 times as large as that before. Accordingly, there will be an increase in electric field strength between the charge-storage layer 8 and the lower electrode, in the grounded portion of the diaphragm, whereupon a band structure of a tunneling barrier layer between the charge-storage layer 8 and the lower electrode undergoes deformation to thereby cause the Fowler-Nordheim tunneling current to flow, so that electric charges are stored in the charge-storage layer 8. When the DC bias is lowered with the diaphragm kept in that state, an upper layer and a lower layer are parted from each other again as shown in FIG. 9, so that the electric field strength decreases due to the effect of an increase in distance between the upper and lower electrodes, in addition to the effect of a decrease in voltage across the upper and lower electrodes, thereby preventing occurrence of Fowler-Nordheim tunneling. For this reason, the electric charges that are once present in the charge-storage layer 8 can have a relatively long life, and remain in the charge-storage layer 8, so that the diaphragm is caused to vibrate at amplitude proportional to an amplitude of an AC pulse, and a quantity of stored electricity by simply applying the AC pulse henceforth without applying the DC bias, thereby enabling ultrasonic waves to be transmitted. Further, in the case of ultrasonic waves arriving from outside, an electric current proportional to the quantity of the stored electricity, and variation of electrostatic capacity, due to deformation of the diaphragm, will flow between the upper and lower electrodes without applying the DC bias, so that the device can be used as a sensor for ultrasonic waves. As for the charge-injection method, a method using hot electrons is also available besides the method utilizing Fowler-Nordheim tunneling, however, in the case of the method using hot electrons, it is necessary to incorporate a transistor for exclusive use. Effects of the device, in the case of electric charges actually being stored, are described hereinafter by use of results of experiments conducted on a prototype device. In FIG. 13, the horizontal axis indicates DC bias voltage, and the vertical axis indicates sensitivity of transmitting/receiving waves. A solid line shows sensitivity of transmitting/receiving waves, prior to charge-storage, and a dotted line shows sensitivity of the transmitting/receiving waves, after the charge-storage. It is shown that prior to the charge-storage, the sensitivity of the transmitting/receiving waves is 0 at a point where the DC bias voltage is 0V, the sensitivity increasing according to an increase in absolute value of the DC bias voltage. Meanwhile, a curve of the sensitivity of the transmitting/receiving waves, after the charge-storage, is shown to shift according to a quantity of stored electricity, as indicated by the dotted line. If V1 shown in FIG. 13 is equal to a drive bias voltage intended for use prior to the charge-storage, the bias voltage becomes unnecessary after the charge-storage. Even in the case of V1 being smaller than the drive bias voltage as intended prior to the charge-storage, it is possible to use the bias voltage after the charge-storage, as decreased by V1. There are obtained advantages such as enhancement in safety, particularly in the case of using the device that is kept in contact with a living body, upon a decrease in the bias voltage, and capability of designing a signal processing circuit for transmitting and receiving signals on the basis of a lower withstanding voltage.

Next, time-dependent change in stored charge is reviewed hereinafter. As it is desirable to transmit ultrasonic waves with a signal-to-noise ratio in a state as low as possible, there has been earlier described a case where the device in such a state as shown in FIG. 9 is used as an ultrasonic transducer, however, in reality, there are many cases where the AC pulse at a high voltage close to the collapse voltage is applied. In such cases, a state in which a thickness of the void 4 becomes zero, as shown in FIG. 7, is instantaneously experienced. In the case of a resonance frequency at 10 MHz, the central part of the diaphragm is grounded for a time period equivalent to about one tenth of one period, that is, for a time period on the order of 10 ns. Since this is repeated every time an ultrasonic wave is transmitted, stored charges move back to either the upper electrode or the lower electrode in a process reverse to that of the charge-injection. With a diaphragm-based ultrasonic transducer of a charge-storage type, the sensitivities in the transmitting/receiving waves, respectively, are proportional to the quantity of stored electricity, as previously described. Accordingly, the sensitivity of the ultrasonic transducer undergoes deterioration over time. For example, in the case of an ultrasonic transducer installed inside piping for the purpose of nondestructive inspection, in order to periodically monitor a thickness of piping within a power plant, if the sensitivity of the ultrasonic transducer varies over time, this will cause deterioration in precision for monitoring time-dependent change in the thickness. Further, when an array type transducer is manufactured by gathering up a plurality of the electro-acoustic transducer devices according to the invention, drift components such as time-dependent change in the quantity of the stored electricity will generally vary on a device-by-device basis, so that a problem is encountered in that sensitivity will be changed on a device-by-device basis within the array of the devices.

Figure 10:
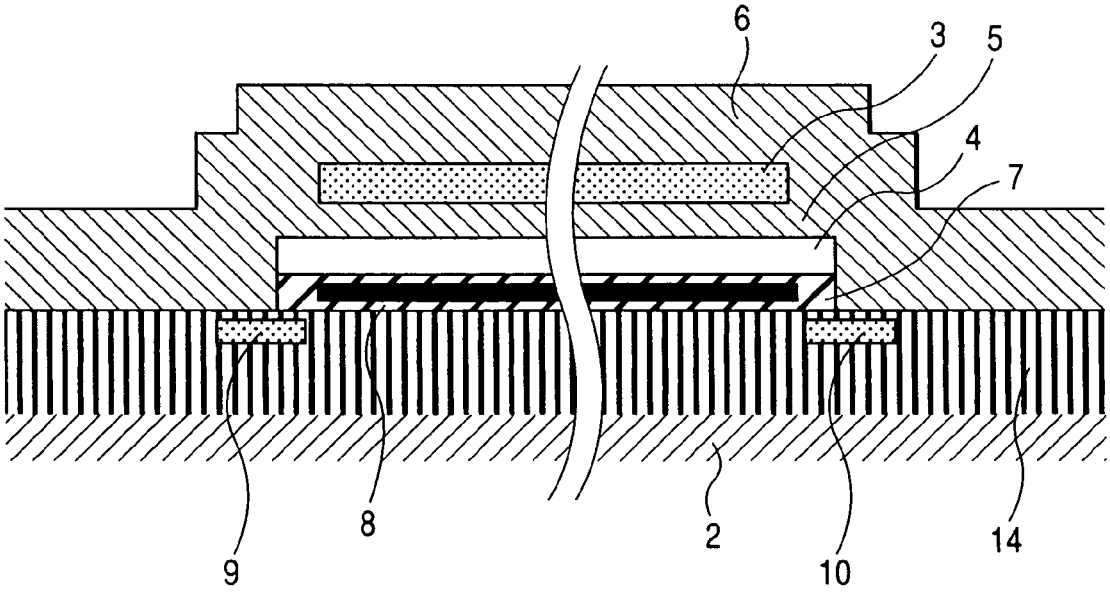
FIG. 10 is a sectional view showing the electro-acoustic transducer device according to the embodiment of the invention, using silicon as the base material, particularly, in a form with a unit for monitoring a quantity of stored electricity included therein.
Figure 15:
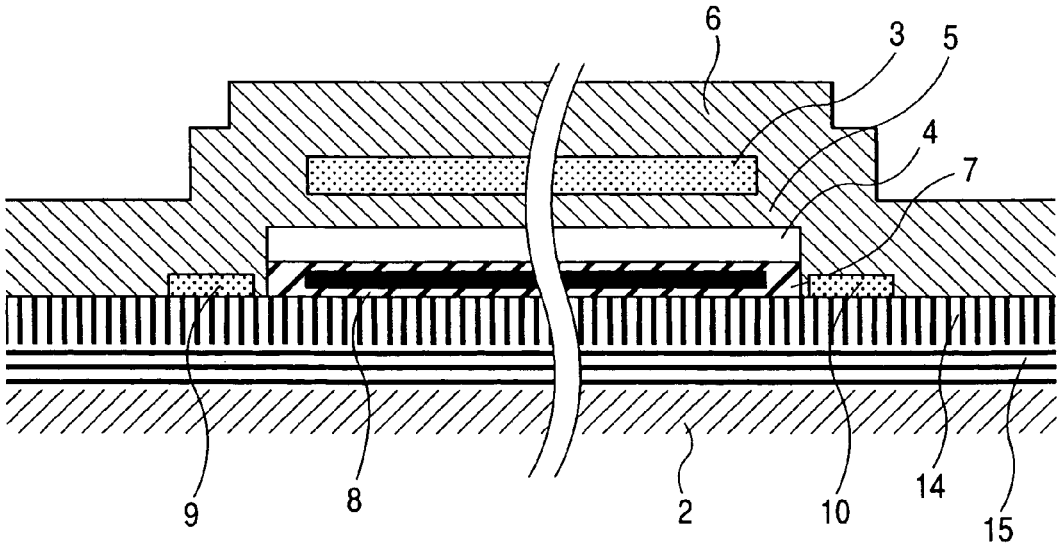
FIG. 15 is a sectional view showing still another embodiment of an electro-acoustic transducer device according to the invention, using silicon as a base material, particularly, in a form with a unit for monitoring a quantity of stored electricity included therein.

Accordingly, with the present invention, there is provided a stored-charge monitoring mechanism inside a transducer device, as shown in FIG. 10 by way of example. Reference numerals 9, 10 denote a source electrode, and a drain electrode, provided in a substrate, respectively, and reference numeral 14 denotes a fourth silicon compound layer. If the source electrode, and the drain electrode each are formed of, for example, an n-type semiconductor, the fourth silicon compound layer 14 is, to the contrary, formed of a p-type semiconductor. Reference numeral 2 denotes a lower electrode formed of a silicon compound more heavily doped than the semiconductor of the fourth silicon compound layer 14, a metal, and so forth. An electron conduction channel between the source electrode and the drain electrode has resistance proportional to a quantity of electricity stored in the charge-storage layer 8. That is, this is because the stored-charge monitoring mechanism has a structure equivalent to that of a field effect transistor in which the charge-storage layer 8 acts as a gate. Accordingly, by periodically measuring the respective resistances of the charge-storage layer 8, and the source electrode 9, it becomes possible to estimate a quantity of electricity remaining in the charge-storage layer 8. As shown in FIG. 15, the fourth silicon compound layer 14 can be made up of a fourth silicon compound layer 14, and a fifth silicon compound layer 15, differing in band gap from each other, thereby enabling an interface therebetween to be used as an electron conduction channel of the field effect transistor, and by spatially localizing the electron conduction channel, it is also possible to enhance sensitivity against the stored charge of the charge-storage layer 8. In order to vary the band gap, for example, one of the silicon compound layers may be formed of silicon and the other may be formed of a mixture of silicon carbide and silicon, whereupon such a change can be implemented. When a change in response to a change in the quantity of the stored electricity is small, a change component is used for making correction as a correction coefficient, and when the change component is large, the change component can be used as a criterion for making a decision on the charge re-injection. Needless to say, a method of using the device is conceivable whereby re-injection of the charge is periodically repeated without execution of monitoring, however, if flow of an excessive current, through an insulating layer serving as a tunneling path, is repeated, this will lead to deterioration in the property of the insulating layer. Hence, it is desirable to control execution of the charge re-injection to the fewest necessary times. Further, in the case where the ultrasonic transducer as a sensor is installed at a spot, access to which is not easy, such as a spot inside the piping within the power plant, as previously described, a large advantage is gained if correction can be made only with the use of the correction coefficient when the change in the quantity of the stored electricity is small. An application form of the ultrasonic transducer is conceivable, wherein in the case of monitoring by use of one unit of the electro-acoustic transducer device, such as monitoring at a fixed point of the piping, and so forth, monitoring can be basically done with correction only, and the re-injection of the electric charge by use of an external power supply is executed at times of maintenance and so forth.

Meanwhile, in the case of, for example, picking up a tomogram for medical application, it becomes necessary to correct a transmitting wave voltage and a receiving wave voltage by the channel if there is sensitivity variation at several dB by the device, thereby complicating processing, so that an application method is conceivable whereby the re-injection of electric charge is executed in a stage where the sensitivity deteriorates by 2 to 3 dB, due to a decrease in the quantity of the stored electricity. It is possible in theory to compensate for an effective decrease in the DC bias, due to a change in the quantity of the stored electricity, by increasing the amplitude of the AC pulse. However, if the amplitude of the AC pulse is changed on a device-by-device basis, variation occurs to results of sensitivity correction on the device-by-device basis, due to effects of variation in non-linear characteristics of amplifiers driving the individual devices, thereby causing deterioration in beam characteristics. Further, there is available a method whereby a value of the DC bias to be applied is corrected on the device-by-device basis so as to superimpose on the effect of the quantity of the stored electricity instead of the correction of the amplitude of the AC pulse, however, if the voltage differs largely by the bias control line, this will still cause variation in the characteristics on the device-by-device basis. For the reasons described as above, with the array of the electro-acoustic transducer devices, a threshold voltage at the time of operation shifting from the correction to the charge re-injection is preferably set to a level on a lower side.

Figure 12:
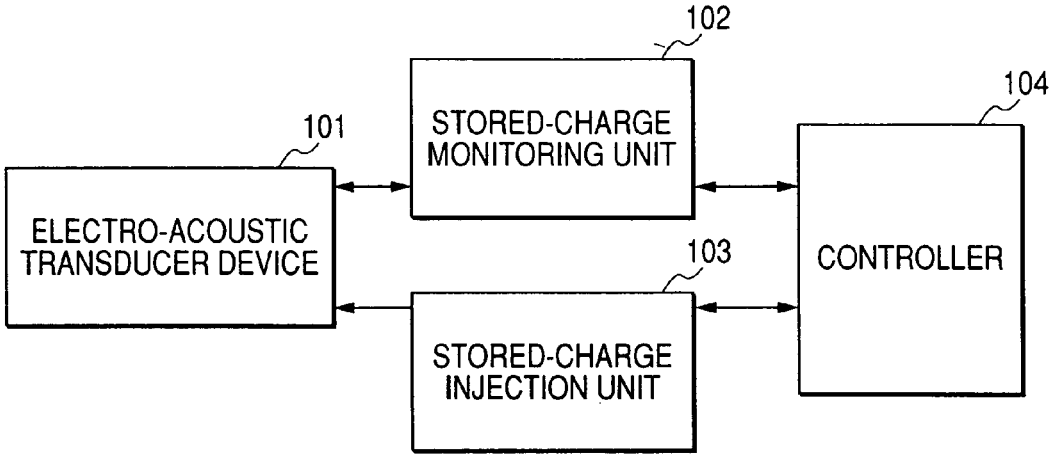
FIG. 12 is a block diagram of a system for monitoring the quantity of the stored electricity.

Referring to FIG. 12, control using results of stored-charge monitoring is described hereinafter. In the case where an amount of a change in the stored-charge, according to the results of monitoring by a stored-charge monitoring unit 102 connected to an electro-acoustic transducer device 101, is not more than a threshold pre-stored in a controller 104, a correction coefficient is altered against a transmitting a wave amplitude of a transmitting wave circuit (not shown), and an amplification factor of a receiving wave circuit (not shown) If the amount of the change exceeds the threshold, the re-injection of the charge into the electro-acoustic transducer device 101 is executed by a stored-charge injection unit 103.

Figure 11:
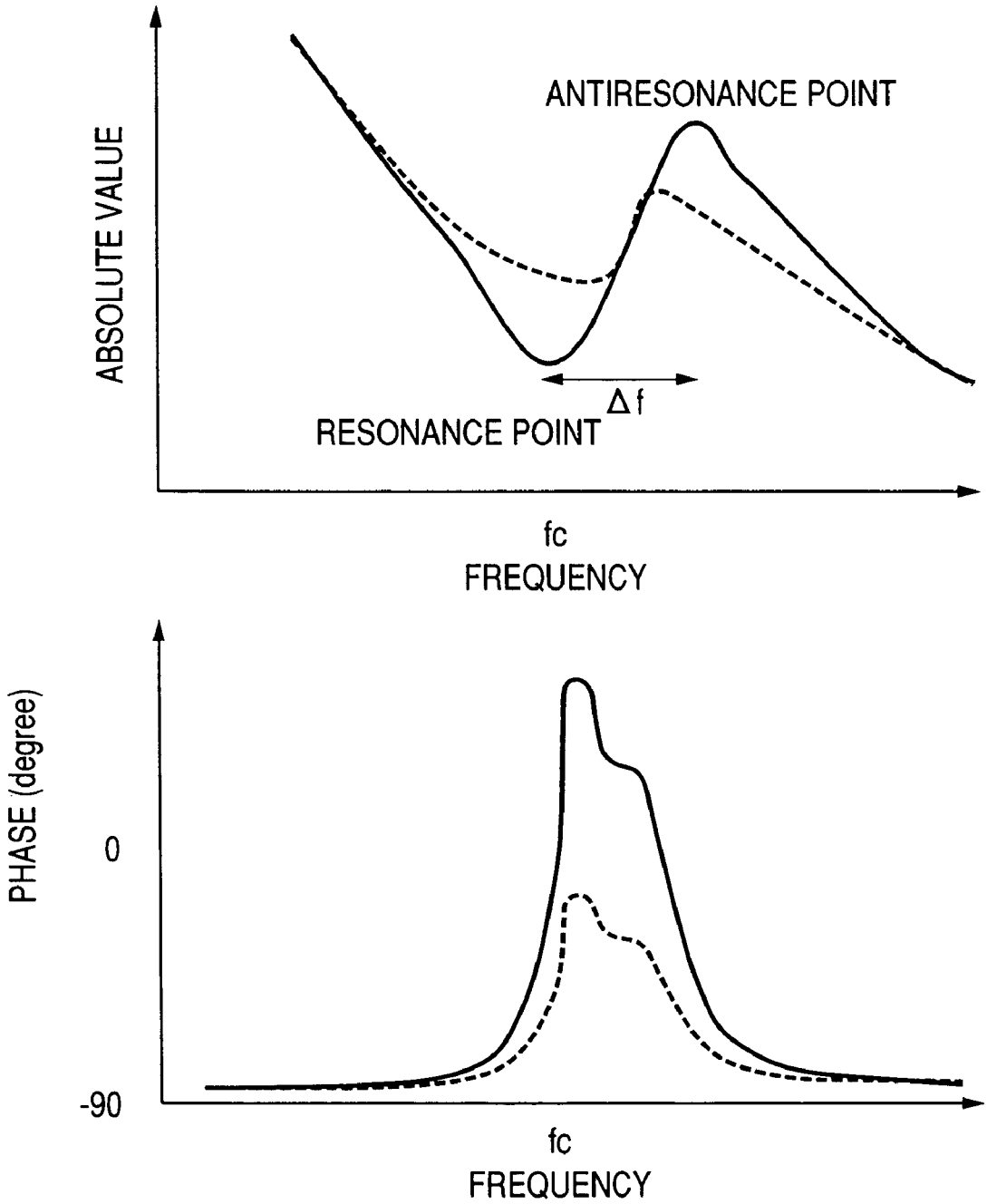
FIG. 11 is a diagram showing a form of monitoring a quantity of stored electricity.

There has been described an example in which a structure similar to a field effect transistor is used as a monitoring scheme for the quantity of the stored electricity, however, there is also available a technique for monitoring the quantity of the stored electricity by means of a system according to another embodiment of the invention, instead of incorporating the stored-charge monitoring mechanism in the device. As shown in FIG. 11, the monitoring is possible by evaluating frequency characteristics of phase components of impedance of the diaphragm. If the electro-mechanical conversion efficiency of the diaphragm is high, there will be an increase in distance between a point of the minimum absolute value of the impedance, and a point of the maximum absolute value thereof. By monitoring the distance Δf between the point of the minimum absolute value of the impedance, and the point of the maximum absolute value thereof, it is possible to monitor the electro-mechanical conversion efficiency of the diaphragm, that is, the quantity of the stored electricity. Further, it is also possible to execute the monitoring by use of phase components of the impedance. When the electro-mechanical conversion efficiency of the diaphragm is high, that is, the quantity of the stored electricity is large, a ratio of conversion from electric energy to mechanical energy is high in the vicinity of a resonance frequency, so that the diaphragm, if it is assumed as an electrical circuit, behaves as inductance while efficiency of the conversion from the electric energy to the mechanical energy considerably decreases at frequencies other than the resonance frequency, behaving nearly as a capacitor. Accordingly, the phase components of the impedance, at the frequencies other than the resonance frequency (fc), are at −90°, as indicated by a solid line in the figure, and are at +90° in the vicinity of the resonance frequency. As the quantity of the stored electricity decreases, peaks of the phase components at +90° become lower as indicated by a dotted line in FIG. 11, so that this can be detected as a change in the stored charge. Whether use is made of the absolute value of the impedance, or the phase components in execution of the monitoring is dependent on the electro-acoustic transducer device. More specifically, in the case of transmitting sound in the air, the diaphragm of the electro-acoustic transducer device is in use with little load thereon, a detection method using the phase has a higher sensitivity. On the other hand, in the case of transmitting waves to, or receiving waves from a solid body such as a living body, and water, or a solid body for use in nondestructive inspection, a target for wave-transmission will impose a large load on the diaphragm, so that there can be cases where the peaks of the phase components cannot be easily observed. In such a case, it is more desirable to monitor a change in the absolute value of the impedance than to monitor a change in the peaks of the phase components. A specific technique for monitoring the impedance as shown in FIG. 11 is described hereinafter. A pulse voltage is applied across the upper electrode and the lower electrode to thereby monitor a current flowing between both the electrodes. It need only be sufficient to set a pulse width so as to have sufficient sensitivity against a frequency component at fc. By obtaining quotient found when a voltage waveform at this point in time, converted into frequency, is divided by a current waveform at this point in time, converted into frequency, frequency characteristics of complex impedance can be found. By expressing complex components thereof in terms of the absolute value and the phase, the phase of impedance, as shown in FIG. 11, is found. In FIG. 11, impedances at a plurality of consecutive frequencies are shown as the frequency characteristics, however, an purpose of monitoring the time-dependent change can be attained by loosely taking discrete samples along the frequency axis, in which case, there is also available a method whereby a voltage in sine waveform at a frequency for sampling is applied across both the electrodes to thereby measure a current flowing therebetween, and measurements on a phase difference between the voltage and the current are taken. In this case, in order to cope with time-dependent change in resonance frequency, measurements are taken with respective frequencies at three to ten spots along the frequency axis, thereby detecting change in the peaks of the phase components while correcting effects of shift in frequency.

In a still another embodiment of the invention, a still another method is possible whereby a value of the current flowing between the upper and lower electrodes is constantly monitored, and an integration value thereof is used in making judgment.

With the embodiments of the invention, described hereinbefore, there has been described a diaphragm structure in which silicon nitride ($Si_3N_4$) is used by way of example, however, it is to be pointed out that besides silicon nitride, use can be made of material easy for forming in a semiconductor processing, such as $SiO_2$, SiC, poly-Si, and so forth, semiconductor of compounds other than Si-based compounds, such as GaAs, and so forth, and a metal such as tungsten, copper, and so forth. Furthermore, a composite made of a polymer such as polyimide, and so forth, and a semiconductor can be used for the diaphragm. Particularly, in the case where a semiconductor part is small in thickness, and a polyimide film serving as a protective film is attached to the surface of the semiconductor part, the polyimide film as the protective film can double as the diaphragm. Further, there has been described an example in which aluminum is used for the electrodes, however, other metals such as copper, gold, platinum, tungsten, and so forth can obviously be used for the electrodes. Furthermore, an alloy made of a plurality of metals, and a semiconductor with controlled conductivity can also be used for the electrodes.

What is claimed is:

1. An electro-acoustic transducer device comprising:

a substrate using silicon or a silicon compound as a base material thereof;

a first electrode formed on top of, or inside the substrate;

a thin film using silicon or a silicon compound as a base material thereof, provided on top of the substrate;

a second electrode formed on top of, or inside the thin film;

a void layer provided between the first electrode and the second electrode;

a charge-stored layer for storing charge given by the first electrode and the second electrode, provided between the first electrode and the second electrode; and a source electrode, and a drain electrode, for measuring a quantity of electricity stored in the charge-storage layer.

2. An electro-acoustic transducer device according to claim 1, wherein the substrate comprises a first silicon compound layer, and a second silicon compound layer, forming respective band gaps differing from each other, and the first silicon compound layer and the second silicon compound layer are provided such that an interface therebetween is positioned in close proximity of the source electrode and the drain electrode.

3. An electro-acoustic transducer device according to claim 1, wherein the thin film has a protruded part such that the protruded part is formed in close proximity of a central part of the void layer.

4. An electro-acoustic transducer device according to claim 1, wherein the charge-stored layer has a conductive layer therein.

5. An electro-acoustic transducer device according to claim 4, wherein the conductive layer is formed so as to be in dot-like shape.

6. An electro-acoustic transducer device according to claim 1, wherein the charge-stored layer is a silicon nitride layer.

7. An electro-acoustic transducer device according to claim 1, wherein the source electrode and the drain electrode are provided in close proximity of respective ends of the charge-stored layer.

8. An electro-acoustic transducer device according to claim 3, wherein the charge-storage layer has a radius smaller than a radius of the protruded part.

9. An electro-acoustic transducer device according to claim 1, wherein the silicon compound is silicon nitride.

* * * * *